US010738612B2

(12) United States Patent
Wu et al.

(10) Patent No.: US 10,738,612 B2
(45) Date of Patent: Aug. 11, 2020

(54) SUBMARINE SHALLOW HYDRATE EXPLOITATION DEVICE AND EXPLOITATION METHOD THEREOF

(71) Applicant: Qingdao Institute of Marine Geology, Qingdao (CN)

(72) Inventors: Nengyou Wu, Qingdao (CN); Gaowei Hu, Qingdao (CN); Changling Liu, Qingdao (CN)

(73) Assignee: QINGDAO INSTITUTE OF MARINE GEOLOGY, Qingdao (CN)

( * ) Notice: Subject to any disclaimer, the term of this patent is extended or adjusted under 35 U.S.C. 154(b) by 0 days.

(21) Appl. No.: 16/705,163

(22) Filed: Dec. 5, 2019

(65) Prior Publication Data

US 2020/0182055 A1 Jun. 11, 2020

(30) Foreign Application Priority Data

Dec. 6, 2018 (CN) ..... 2018 1 1485346

(51) Int. Cl.
*E21C 50/00* (2006.01)
*E02F 5/00* (2006.01)
*E21B 3/00* (2006.01)

(52) U.S. Cl.
CPC ..... *E21C 50/00* (2013.01); *E02F 5/006* (2013.01); *E21B 3/00* (2013.01)

(58) Field of Classification Search
CPC ..... E21C 50/00
USPC ..... 37/313, 324, 325, 326, 317, 323; 299/9, 299/8, 7
See application file for complete search history.

(56) References Cited

U.S. PATENT DOCUMENTS 3,941,423 A * 3/1976 Garte ..... E21B 4/14 299/8
4,010,560 A * 3/1977 Diggs ..... E02F 3/082 37/308
4,141,159 A * 2/1979 Morris ..... E02F 3/88 241/1
4,204,347 A * 5/1980 Wolters ..... E02F 3/905 37/310

(Continued)

FOREIGN PATENT DOCUMENTS

CN 108222892 A 6/2018
JP 06033478 A * 2/1994

*Primary Examiner* — Janine M Kreck
*Assistant Examiner* — Michael A Goodwin
(74) *Attorney, Agent, or Firm* — Bayramoglu Law Offices LLC

(57) ABSTRACT

A submarine shallow hydrate exploitation device, including an exploitation unit and a collection unit. The exploitation unit includes: a submarine ship working on a seabed; a drain chamber arranged on the submarine ship, wherein a pressure valve is arranged at a top of the drain chamber, one-way drain holes are formed in a bottom of the drain chamber, and water from massive hydrates is controlled to be discharged out of the drain chamber; a high-speed spiral bit configured to mine and convey sediments; a rotary ring arranged at an inlet end of the drain chamber and configured to connect the drain chamber with the high-speed spiral bit to provide rotation power for the high-speed spiral bit; a steering arm arranged on the submarine ship and configured to realize a rotation of the high-speed spiral bit; a crusher arranged on the submarine ship and configured to crush dried massive hydrates.

9 Claims, 1 Drawing Sheet

(56) References Cited

U.S. PATENT DOCUMENTS

| | | | | | |
|---|---|---|---|---|---|
| 4,232,903 | A * | 11/1980 | Welling | E02F 3/907 | 299/8 |
| 4,685,742 | A * | 8/1987 | Moreau | E02F 3/8858 | 299/8 |
| 5,328,250 | A * | 7/1994 | Upright | E02F 7/005 | 299/8 |
| 5,950,732 | A * | 9/1999 | Agee | C10G 2/30 | 166/354 |
| 6,003,952 | A * | 12/1999 | Smart | E02F 5/006 | 299/75 |
| 6,178,670 | B1 * | 1/2001 | Susman | E02F 3/8858 | 175/107 |
| 2008/0088171 | A1 * | 4/2008 | Cheng | E21B 41/0064 | 299/10 |
| 2008/0135257 | A1 * | 6/2008 | Zhang | E21B 43/0122 | 166/352 |
| 2011/0309668 | A1 * | 12/2011 | Efthymiou | E02F 7/065 | 299/17 |
| 2013/0038113 | A1 * | 2/2013 | Wakita | E02F 3/8866 | 299/39.2 |
| 2013/0312296 | A1 * | 11/2013 | Jones | E02F 3/8866 | 37/317 |

* cited by examiner

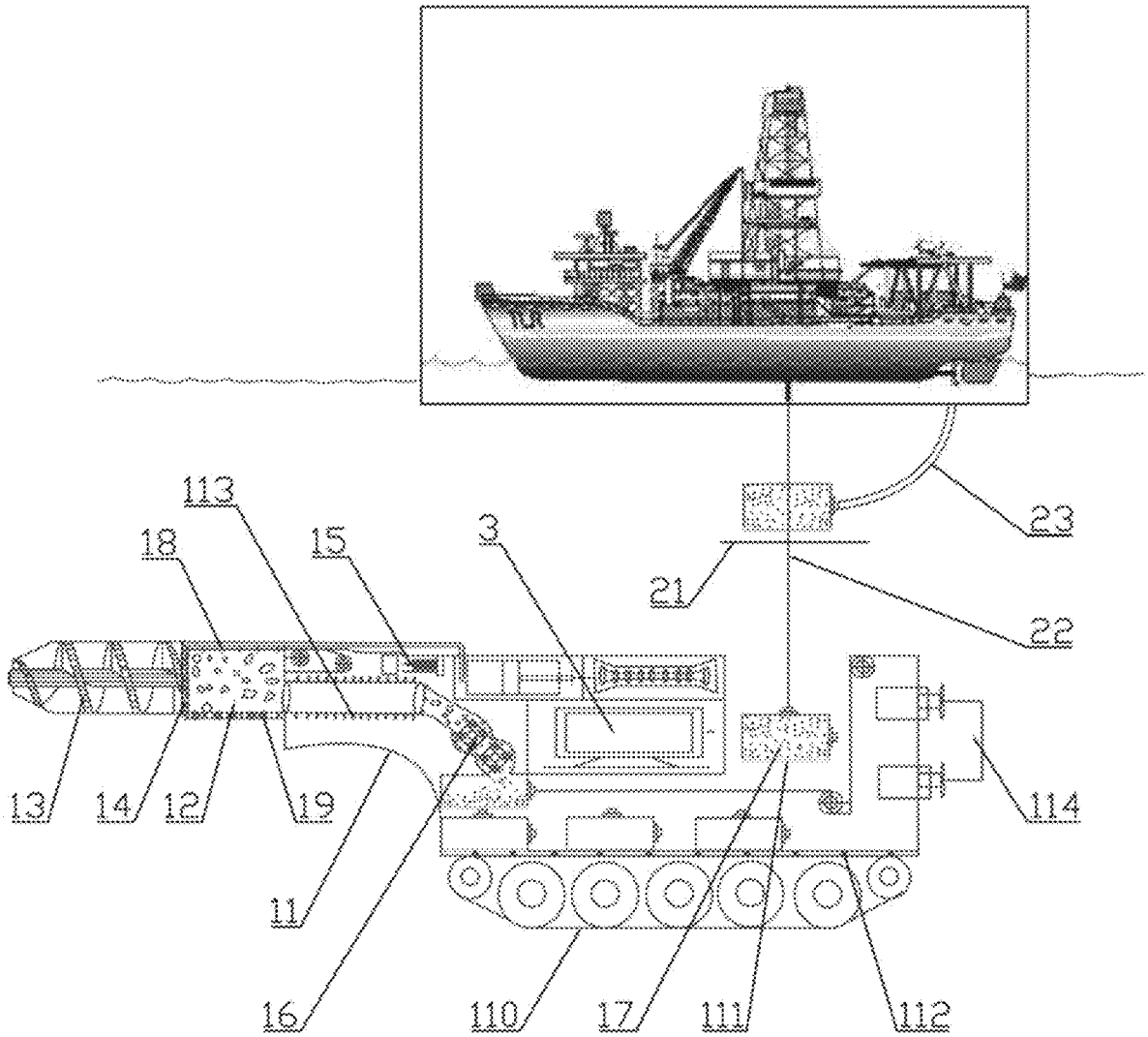
113
18
15
3
23
21
22
13
14
12
19
114
11
16
110
17
111
112

SUBMARINE SHALLOW HYDRATE EXPLOITATION DEVICE AND EXPLOITATION METHOD THEREOF

CROSS REFERENCE TO THE RELATED APPLICATIONS

This application is based upon and claims priority to Chinese Patent Application No. 201811485346.X, filed on Dec. 6, 2018, the entire contents of which are incorporated herein by reference.

TECHNICAL FIELD

The invention relates to the technical field of unconventional oil-gas exploitation, in particular to a submarine shallow hydrate exploitation device and an exploitation method thereof.

BACKGROUND

As a highly potential energy resource, natural gas hydrate is widely distributed in oceans and ever frozen soil around the world, and hydrates have already been discovered in the seabed of the Source China sea and in frozen soil of the Qilian Mountain.

Because of the unique physical and chemical properties and variable dynamic characteristics of the hydrates in different environments, geologies and landforms with different characteristics may be presented on the seabed in the formation, migration and decomposition process of the hydrates. Investigations reveal that submarine landforms such as submarine pits, submarine mud volcanoes, cold springs and hydrate hills are closely related to the hydrates and are advantageous geological evidences indicating the presence of hydrates. Submarine mud volcanoes, pits and hydrate hills have been successively discovered in various countries such as in Blake Plateau, American Hydrate Ridge, Gulf of Mexico, Yulong Basin of Korea, Nankai Trough in Japan, Barbados Island, Mediterranean Sea, Caspian Sea, Okhotsk Sea and other sea areas, and a large quantity of hydrates have been found in these special submarine landform development areas.

An efficient and authoritative exploitation device for massive hydrates reserved in mud volcanoes, pits and hydrate hills in shallow sea areas has not been invented yet at present. The invention provides an intelligent mining vehicle lifting and pressure releasing device for massive hydrates in shallow sea areas. According to the intelligent mining vehicle lifting and pressure releasing device for submarine shallow massive hydrates, a submarine mining vehicle is controlled by a ship on the sea surface to mine hydrates and sediments on the seabed and then to and crush the hydrates which are in turn lifted by a mooring rope of the ship to a shallow position to be heated, and the hydrates are promoted to be decomposed by means of changes to the phase equilibrium conditions of the hydrates. This intelligent mining vehicle lifting and pressure releasing device for submarine shallow massive hydrates has the advantages of being efficient, economical, and the like.

Chinese invention Patent Publication No. CN108222892 provides an exploitation device and method for continuous exploitation of marine natural gas hydrates. In this patent, a drilling approach is adopted and is implemented in such as manner that a drill pipe is stretched into a hydrate reservoir (a certain depth under the seabed) to crush hydrates along the reservoir by means of a high-pressure water flow, and exploitation device and method carry out exploitation on the basis of a solid fluidization method and are typically used to exploit hydrates within a certain depth of the sea.

SUMMARY

The objective of the invention is to design a submarine shallow hydrate exploitation device used to exploit massive hydrates distributed in shallow and surface layers of submarine mud volcanoes, pits and hydrate hills.

The invention discloses a submarine shallow hydrate exploitation device which is designed in such a manner: an exploitation unit mines hydrates and sediments on a seabed and then dries and crushes the hydrates, and then the crushed hydrates are lifted by a lifting device to a hydrate decomposition station and are heated. In the invention, the hydrates are decomposed in the hydrate decomposition station constructed on a shallow marine layer which has a low pressure and a high temperature with respect to the submarine environment and possesses a unique temperature and pressure condition for hydrate decomposition, and auxiliary heating is carried out to increase the decomposition rate of the hydrates.

The technical solution adopted by the invention to fulfill the above objective is as follows: the submarine shallow hydrate exploitation device comprises an exploitation unit and a collection unit. The exploitation unit comprises a submarine ship, a drain chamber, a spiral bit, a rotary ring, a steering arm, a crusher, and a decomposition tank, wherein the submarine ship works on a seabed; the drain chamber is arranged on the submarine ship, a pressure valve is arranged at the top of the drain chamber, one-way drain holes are formed in the bottom of the drain chamber, and water from massive hydrates is controlled to be discharged out of the drain chamber; the spiral bit is used to mine and convey sediments; the rotary ring is arranged at an inlet end of the drain chamber and is used to connect the drain chamber with the high-speed spiral bit to provide rotation power for the high-speed spiral bit; the steering arm is arranged on the submarine ship and is used to realize rotation of the high-speed spiral bit; the crusher is arranged on the submarine ship and is used to crush the dried massive hydrates; and the decomposition tank is used to collect the hydrates crushed in the crusher. The collection unit comprises a hydrate decomposition station, a lifting device, and a gas collection pipe, wherein the hydrate decomposition station is arranged on a shallow marine layer, the lifting device is used to transfer the decomposition tank to the hydrate decomposition station, and the gas collection pipe is movably arranged on the decomposition tank and is used to recover and store gas generated in the decomposition tank after decomposition.

Furthermore, the submarine shallow hydrate exploitation device further comprises a track arranged at the bottom end of the submarine ship and used to realize traveling of the submarine ship and to compact a goaf.

Furthermore, a spiral blade is arranged in a cavity of the high-speed spiral bit, the rear end of the spiral blade is communicated with the drain chamber, and the front end of the spiral blade is in the shape of a sharp corner to be used for mining and conveying.

Furthermore, the submarine shallow hydrate exploitation device further comprises a heating bottom plate arranged on the decomposition tank and used to promote the decomposition of the hydrates in the decomposition tank.

Furthermore, the submarine shallow hydrate exploitation device further comprises a first conveyor arranged on the submarine ship and used to convey the decomposition tank to a sampling site of the lifting device.

Furthermore, the submarine shallow hydrate exploitation device further comprises a second conveyor arranged on the submarine ship and used to convey the dried massive hydrates into the crusher.

Furthermore, the steering arm is arranged at the rear end of the drain chamber.

Furthermore, the submarine shallow hydrate exploitation device further comprises turbine propeller arranged at the rear end of the submarine ship and used to drive the submarine ship to advance.

An exploitation method of the submarine shallow hydrate exploitation device comprises the following steps:

A, flexibly mining, by the spiral bit driven by the steering arm, massive hydrates at multiple angles and in multiple directions;

B, conveying the massive hydrates mined by the spiral bit into the drain chamber, wherein water in the drain chamber flows towards seawater;

C, conveying the dried massive hydrates into a crusher set to be crushed;

D, loading crushed fragmental hydrates into the hydrate decomposition tank, and replacing, after the hydrate decomposition tank is full of the fragmental hydrates, the full hydrate decomposition tank with an empty hydrate decomposition tank;

E, lifting the hydrate decomposition tank full of the fragmental hydrates to the hydrate decomposition station by the lifting device, and then decomposing the fragmental hydrates to generate gas;

F, recovering and storing the gas generated after decomposition by the gas collection pipe; and G, releasing sediments for backfilling after the hydrates in the decomposition tank are completely decomposed.

Furthermore, in Step E, heating is carried out by the heating bottom plate under the hydrate decomposition tank to promote the decomposition of the hydrates.

The submarine shallow hydrate exploitation device and the exploitation method thereof have the functions of exploitation, mining, draining, crushing, interaction control, and lifting and have the following beneficial effects:

(1) Mass exploitation of submarine shallow hydrates is realized, and in actual production, multiple mining vehicles can be used to work synchronously, so that the exploitation efficiency is high;

(2) In the whole collection stage, the high-speed spiral bit rotates to dry, convey, crush and load the hydrates, the speed is high in the whole process, and the hydrates are barely decomposed, so that the environmental benefits are remarkable;

(3) The hydrates are decomposed on a shallow marine layer which has a low pressure and a high temperature with respect to the seabed and possesses a unique temperature and pressure condition for hydrate decomposition, and auxiliary heating is carried out to increase the decomposition rate of the hydrates;

(4) The hydrate decomposition tank is connected with the ship and the mining vehicle, and the goaf is backfilled with sediments generated after the hydrates are completely decomposed and is compacted by the track of the mining vehicle, so that geological disasters such as landslides and collapses are avoided.

(5) After being loaded into the decomposition tank, the hydrates are lifted to a certain height of the sea to be decomposed and to collect gas; and in the gas collection stage, energy is output only for heating of the bottom plate of the hydrate decomposition tank except gas collection of the ship, semi-automatic hydrate decomposition is achieved, and economical benefits are remarkable.

BRIEF DESCRIPTION OF THE DRAWING

FIGURE shows a structural diagram of a submarine shallow hydrate exploitation device of this application.

In the FIGURE: 11, submarine ship; 12, drain chamber; 13, spiral bit; 14, rotary ring; 15, steering arm; 16, crusher; 17, decomposition tank; 18, pressure valve; 19, one-way drain hole; 110, track; 111, heating bottom plate; 112, first conveyor; 113, second conveyor; 114, turbine propeller;

21, hydrate decomposition station; 22, lifting device; 23, gas collection pipe;

3, control system.

DETAILED DESCRIPTION OF THE EMBODIMENTS

For the sake of a further explanation of the technical means adopted by the invention to fulfill the expected objective as well as the effects of the invention, specific implantations, structures, characteristics and effects of the invention are detailed below in combination with the accompanying drawings and preferred embodiments.

In the invention, an intelligent submarine mining vehicle is used to exploit submarine shallow hydrates, the mining vehicle is able to autonomously travel on the seabed to achieve multi-angle flexible exploitation of hydrate reservoirs, the key device in the mining vehicle has a simple principle, and the work efficiency is high; the hydrates are decomposed in a hydrate decomposition station constructed in a shallow marine environment, and in principle, a pressure field (at a low pressure with respect to the seabed) on the shallow marine layer and auxiliary heating are adopted to automatically destroy the phase equilibrium state of the hydrates to promote the decomposition of the hydrates, so that multi-phase separation of the hydrates and gas production are realized finally; and multiple submarine mining vehicles can be launched to the seabed at the same time to continuously, efficiently and synchronously exploit hydrates, thus realizing efficient, economical, environment-friendly and safe exploitation of the submarine shallow hydrates.

As shown in FIG. 1, a submarine shallow hydrate exploitation device comprises an exploitation unit and a collection unit, wherein the exploitation unit comprises a submarine ship 11, a drain chamber 12, a spiral bit 13, a rotary ring 14, a steering arm 15, a crusher 16, and a decomposition tank 17.

Particularly:

The submarine ship 11 works on a seabed and has other parts installed thereon. The drain chamber 12 is arranged on the submarine ship 11, a pressure valve 18 is arranged at the top of the drain chamber 12 and provides a pressure by means of a hydraulic press, and one-way drain holes 19 are formed in the bottom of the drain chamber 12, and water from massive hydrates is discharged out of the drain chamber 12, so that a drain function is realized. The spiral bit 13 is used to mine and convey sediments, the rotary ring 14 is arranged at an inlet end of the drain chamber 12 and is used to connect the drain chamber 12 with the high-speed spiral bit 13 to provide rotation power for the high-speed spiral bit 13, and in this way, the spiral bit 13 is able to mine and convey hydrate ice blocks in the using process and has the characteristic of rapid and automatic conveying. Preferably, a spiral blade is arranged in a cavity of the high-speed spiral bit 13, the rear end of the spiral blade is communicated with the drain chamber 12, and the front end of the spiral blade is in the shape of a sharp corner to mine and convey hydrates; the spiral blade is able to rotate at a high speed to exploit submarine shallow hydrates and to convey the exploited hydrates into the drain chart chamber 12, so that time is saved, and efficiency is improved. The steering arm 15 is arranged on the submarine ship 11, and particularly, as shown in the FIGURE, the steering arm 15 is arranged at the rear end of the drain chamber 12 and is used for rotation of the high-speed spiral bit 13; and through the design of the steering arm 15, the spiral bit 13 is able to mine the hydrates in multiple directions and at multiple angles. The crusher 16 is arranged on the submarine ship 11 and is used to crush the dried hydrates to fulfill a crushing function, and multiple crushers 16 can be adopted to realize a better massive hydrate crushing effect. The decomposition tank 17 is used to collect the hydrates crushed in the crusher 16, so that the hydrates can be conveniently conveyed and gathered later.

The collection unit comprises a hydrate decomposition station 21, a lifting device 22 and a gas collection pipe 23. Particularly, the hydrate decomposition station 21 is arranged on a shallow marine layer, and the hydrates are decomposed in the hydrate decomposition station constructed in a shallow marine environment in a principle that the phase equilibrium condition of the hydrates is destroyed by a temperature-pressure field of the shallow marine layer (seawater on the shallow marine layer has a low pressure and a high temperature with respect to the submarine environment) to promote the decomposition of the hydrates, so that energy consumption is reduced. In addition, a heating bottom plate 111 is arranged at the bottom of the decomposition tank 17 to promote the decomposition of the hydrates in the decomposition tank 17 and is mainly used for auxiliary heating to improve the adaptability to different environments.

The lifting device 22 is used to transfer the decomposition tank 17 to the hydrate decomposition station 21, and the hydrate decomposition tank 17 containing small broken hydrates is lifted to the hydrate decomposition station 21 in seawater by means of a ship on the sea surface and the buoyancy force of seawater, so that the hydrates are naturally decomposed. The gas collection pipe 23 is movably arranged on the decomposition tank 17 and is used to recover and store gas generated in the decomposition tank 17 after decomposition, and the top end of the gas collection pipe 23 can be lifted to a gas storage device located on the ship on the sea surface to facilitate gas recovery.

On the basis of the above description, a track 110 is arranged at the bottom end of the submarine ship 11 and is used to realize traveling of the submarine ship 11 and to compact a goaf, and the mining vehicle adopts a track advancing system, so that slipping can be effectively avoided, and the frictional force between the mining vehicle and the seabed is increased. The goaf is backfilled with sediments generated after the hydrates are completely decomposed and is compacted by the track 110, so that geological disasters such as landslides and collapses are avoided. The goaf is backfilled with hydrate sediments generated after decomposition, so that geological disasters such as landslides can be effectively avoided; and the whole working process is carried out at a high speed and can be completed within a short time, so that the influence of hydrate decomposition on the marine environment and marine organisms is effectively avoided.

A first conveyor 112 is arranged on the submarine ship 11 and can be a conveyor belt, and the first conveyor 112 is used to convey an empty hydrate composition tank 17 to the crusher 16 to collect crushed fragmental hydrates and then convey the decomposition tank 17 full of the fragmental hydrates to a sampling site of the lifting device 22. A second conveyor 113 is also arranged on the submarine ship 11, and the second conveyor 113 can be a specially-made conveyor belt and is used to convey dried massive hydrates into the crusher 16. A turbine propeller 114 is arranged at the rear end of the submarine ship 11 and is used to drive the submarine ship 11 to advance. An engine in the exploitation unit is used as a power source to supply power to the track 110, a hydraulic pump, the turbine propeller 114, the first conveyor 112 and the second conveyor 113.

An exploitation method of the submarine shallow hydrate exploitation device comprises the following steps:

A, the spiral bit 13 is driven by the steering arm 15 to flexibly exploit massive hydrates at multiple angles and in multiple directions, and the exploited hydrates are automatically conveyed by the spiral blade in the spiral bit 13;

B, the massive hydrates mined by the spiral bit 13 are conveyed into the drain chamber 12 provided with the pressure valve at the top, supplied with a pressure by the hydraulic pump and provided with the one-way drain holes at the bottom, so that water in the drain chamber is controlled to flow towards seawater, and the mined hydrates are conveyed to the corresponding conveyor belt by wheels arranged at the bottom of the drain chamber;

C, the dried massive hydrates are conveyed by the second conveyor 113 into the crusher 16 to be crushed;

D, the crushed fragmental hydrates are loaded into the hydrate decomposition tank 17; and when one decomposition tank 17 is full of the fragmental hydrates, the hydrate decomposition tank 17 full of the fragmental hydrates is replaced with an empty hydrate decomposition tank 17;

E, the hydrate decomposition tank 17 full of the fragmental hydrates is lifted by the lifting device 22 to the hydrate decomposition station 21, so that gas is obtained by decomposition; and in the case where the temperature of the hydrate decomposition station 21 fails to reach a required temperature, the heating bottom plate 11 under the hydrate decomposition tank 17 is used for heating to promote the decomposition of the hydrates;

F, gas generated after decomposition is recovered and stored by the gas collection pipe 23 and is then delivered into the gas storage device on the sea surface; and G, after the hydrates in the decomposition tank 17 are completely decomposed, sediments are released for backfilling and are compacted by the track 110 to avoid geological disasters such as landslides and collapses.

The invention is described above with reference to preferred embodiments, but the protection scope of the invention is not limited to the above embodiments. Various improvements of the above embodiments and equivalent substitutes of relating parts can be obtained without deviating from the scope of the invention, and all technical characteristics mentioned in the above embodiments can be freely combined without causing structural conflicts. Any reference signs involved in the claims should not be regarded as limitations of the claims referred to. From any point of view, the above embodiments should be appreciated as illustrative and non-restrictive ones. Therefore, any technical solutions within the scope of the claims should also fall within the protection scope of the invention.

What is claimed is:

1. A submarine hydrate exploitation device, comprising an exploitation unit and a collection unit, wherein, the exploitation unit comprises:

a submarine ship working on a seabed;

a drain chamber arranged on the submarine ship, wherein a pressure valve is arranged at a top of the drain chamber, one-way drain holes are formed in a bottom of the drain chamber, and water from hydrates is controlled to be discharged out of the drain chamber;

a spiral bit configured to mine and convey sediments;

a crusher arranged on the submarine ship and configured to crush hydrates; and a decomposition tank configured to collect the hydrates crushed in the crusher;

the collection unit comprises:

a hydrate decomposition station arranged on a position closer to a sea level than the submarine ship;

a lifting device configured to transfer the decomposition tank to the hydrate decomposition station; and a gas collection pipe arranged on the decomposition tank and configured to recover and store gas generated in the decomposition tank after decomposition.

2. The submarine hydrate exploitation device according to claim 1, wherein, the submarine hydrate exploitation device further comprises a track arranged at a bottom end of the submarine ship and configured to realize traveling of the submarine ship and to compact a goaf.

3. The submarine hydrate exploitation device according to claim 1, wherein, a spiral blade is arranged in a cavity of the spiral bit, a rear end of the spiral blade is communicated with the drain chamber, and a front end of the spiral blade is in a shape of a sharp corner.

4. The submarine hydrate exploitation device according to claim 1, wherein, the submarine hydrate exploitation device further comprises a heating bottom plate arranged on the decomposition tank and configured to promote decomposition of hydrates in the decomposition tank.

5. The submarine hydrate exploitation device according to claim 1, wherein, the submarine hydrate exploitation device further comprises a conveyor arranged on the submarine ship and configured to convey the decomposition tank to a site, and the lifting device catches the decomposition tank at the site.

6. The submarine hydrate exploitation device according to claim 1, wherein, the submarine hydrate exploitation device further comprises a conveyor arranged on the submarine ship and configured to convey the hydrates into the crusher.

7. The submarine hydrate exploitation device according to claim 1, wherein, the submarine hydrate exploitation device further comprises a turbine propeller arranged at a rear end of the submarine ship and configured to drive the submarine ship to advance.

8. An exploitation method of the submarine hydrate exploitation device according to claim 1, comprising the following steps:

A, mining, by the spiral bit, the hydrates at multiple angles and in multiple directions;

B, conveying the hydrates mined by the spiral bit into the drain chamber, wherein water in the drain chamber flows towards seawater;

C, conveying the hydrates into the crusher to be crushed to obtain fragmental hydrates;

D, loading the fragmental hydrates of the hydrates into the hydrate decomposition tank, and replacing, after the hydrate decomposition tank is full of the fragmental hydrates, the hydrate decomposition tank with an empty hydrate decomposition tank;

E, lifting the hydrate decomposition tank full of the fragmental hydrates to the hydrate decomposition station by the lifting device, and then decomposing the fragmental hydrates to generate gas;

F, recovering and storing the gas generated after decomposition by the gas collection pipe; and G, releasing sediments for backfilling after the fragmental hydrates in the decomposition tank are completely decomposed.

9. The exploitation method according to claim 8, wherein, in the step E, heating is carried out by a heating bottom plate under the hydrate decomposition tank to promote decomposition of the hydrates.

* * * * *